US006988735B2

(12) United States Patent
Furzer et al.

(10) Patent No.: US 6,988,735 B2
(45) Date of Patent: Jan. 24, 2006

(54) HEATING ARRANGEMENT FOR ICE SKATE BLADES

(75) Inventors: Jeremy Furzer, Sherwood Park (CA); Tory Weber, Sherwood Park (CA)

(73) Assignee: Therma Blade Inc., Sherwood Park (CA)

( * ) Notice: Subject to any disclaimer, the term of this patent is extended or adjusted under 35 U.S.C. 154(b) by 0 days.

(21) Appl. No.: 10/940,679

(22) Filed: Sep. 15, 2004

(65) Prior Publication Data

US 2005/0029247 A1 Feb. 10, 2005

Related U.S. Application Data

(63) Continuation-in-part of application No. 10/015,221, filed on Dec. 12, 2001, now Pat. No. 6,669,209, and a continuation-in-part of application No. 10/459,713, filed on Jun. 12, 2003, now Pat. No. 6,817,618.

(51) Int. Cl.
*A63C 1/00* (2006.01)

(52) U.S. Cl. ..... 280/11.12; 219/201; 219/211

(58) Field of Classification Search ..... 280/11.12, 280/11.14, 11.18, 841; 36/2.6, 119; 219/201, 219/209, 211, 482, 507, 527
See application file for complete search history.

(56) References Cited

U.S. PATENT DOCUMENTS 3,119,921 A * 1/1964 Czaja ..... 219/201
3,866,927 A * 2/1975 Tvengsberg ..... 280/11.12
4,034,489 A 7/1977 Hughes, Jr.
5,441,305 A * 8/1995 Tabar ..... 280/809
5,973,293 A * 10/1999 Reichman ..... 219/211
6,229,132 B1 5/2001 Knetter
6,669,209 B2 * 12/2003 Furzer et al. ..... 280/11.12
6,817,618 B2 * 11/2004 Furzer et al. ..... 280/11.12
2004/0032097 A1 * 2/2004 Furzer et al. ..... 280/11.12

* cited by examiner

*Primary Examiner*—J. Allen Shriver
(74) *Attorney, Agent, or Firm*—Adrian D. Battison; Michael R. Williams; Ryan W. Dupuis

(57) ABSTRACT

An ice skate comprising a boot arranged to receive a person's foot, a skate blade assembly and a blade heating arrangement mounted within a blade mounting arrangement. The blade heating arrangement is arranged to use a field-effect transistor controlled by an electronic controller to operate in the non-linear range to heat skate blades from a power source. The blade is formed as a two part structure with a central core plate within the steel blade part of a higher thermal conductivity material such as copper. The circuit controlling the heating includes a charging component which uses as a contact for the charging current the blade itself. The blade is mounted on the mounting arrangement by a manually releasable mechanical coupling for readily removing the blade and the heating element from its mounting with the manually releasable coupling includes at least one inclined wedge member for co-operating with a corresponding shaped receptacle on the mounting arrangement and a cam lock for pulling the blade along the mounting member longitudinally of the blade and to draw the inclined wedge member into its receptacle.

11 Claims, 6 Drawing Sheets

3
57
2
58
14
56A
56
1

51
52
58
54
53
59
57
60
55
50

HEATING ARRANGEMENT FOR ICE SKATE BLADES

This application is a continuation-in-part application of application Ser. No. 10/015,221 filed Dec. 12$^{th}$ 2001 now issued in Dec. 30, 2003 as U.S. Pat. No. 6,669,209 and a continuation-in-part of application Ser. No. 10/459,713 filed Jun. 12$^{th}$ 2003 and now issued on Nov. 16, 2004 as U.S. Pat. No. 6,817,618.

The present invention relates to a heating arrangement for ice skate blades.

BACKGROUND

Common ice skates used in skating have an elongate blade which is arranged to slide along the ice surface. Attempts to minimise the friction between the blade and the ice using heat are shown in U.S. Pat. No. 3,119,921 (Czaja) and U.S. Pat. No. 3,866,927 (Tvengsberg) which use resistance heating to heat a blade on a skate. Resistance heating uses a high amount of energy and providing enough power to maintain a heated blade for a sufficient length of time would need a large power source. Since the optimal situation is to have a light skate, the above examples would be relatively heavy and cumbersome to use, specifically in prolonged uses. U.S. Pat. No. 5,441,305 (Tabar) discloses a heating system primarily for skis which appears to be speculative in nature and includes a number of different arrangements which could be used.

SUMMARY

It is an object of the present invention to provide an ice skate including a heating system which reduces the coefficient of friction of the blade on the ice.

According to an aspect of the present invention there is provided an ice skate comprising:

a boot arranged to receive a person's foot;

a skate blade assembly;

a blade mounting arrangement arranged to be connected to a sole of the boot and arranged to support a skate blade thereon, and;

a blade heating arrangement having a rechargeable battery power source and a heating element for generating heat from electrical power supplied by the battery power source;

a heat transfer member extending from the heating element to the blade;

an electrical circuit arranged for controlling supply of battery power to the heating element;

wherein a contact for connection to a charging system for charging the battery power source is defined by the blade.

Preferably the blade heating arrangement uses a field-effect transistor controlled by a microprocessor to operate in the non-linear range to heat the skate blade.

Preferably at least part of the heating arrangement including the battery power source is mounted within the mounting arrangement and the heat transfer member extends from the blade to the mounting arrangement.

Preferably the blade heating arrangement has a motion sensor arranged to control the heating of the blade such that when the skate is in use the blade is heated, when the skate is not in use the heat is off.

Preferably the blade has sides which are insulated by a plastic material to provide an insulating layer between the blade and the air.

Preferably at least the heating element of the heating arrangement is mounted on the blade and wherein the blade is mounted on the mounting arrangement by a manually releasable mechanical coupling for readily removing the blade and the heating element from its mounting.

Preferably the manually releasable coupling includes at least one inclined wedge member for cooperating with a corresponding shaped receptacle on the mounting arrangement and a cam lock for pulling the blade along the mounting member longitudinally of the blade and to draw the inclined wedge member into its receptacle.

According to a second aspect of the invention there is provided an ice skate comprising:

a boot arranged to receive a person's foot;

a skate blade assembly;

a blade mounting arrangement arranged to be connected to a sole of the boot and arranged to support a skate blade thereon, and;

a blade heating arrangement having a battery power source, a heating element and an electronic controller for generating heat from electrical power supplied by the battery power source;

wherein at least the heating element of the heating arrangement is mounted on the blade;

and wherein the blade is mounted on the mounting arrangement by a manually releasable mechanical coupling for readily removing the blade and the heating element from its mounting.

Preferably the manually releasable coupling includes at least one inclined wedge member for cooperating with a corresponding shaped receptacle on the mounting arrangement and a cam lock for pulling the blade along the mounting member longitudinally of the blade and to draw the inclined wedge member into its receptacle.

Preferably there is provided a charging system wherein the charging system includes a first contact for engaging the blade and a second contact for engaging the skate at a position thereon spaced from the blade.

Preferably the charging system comprises a skate guard for receiving and holding the blade of the skate.

Preferably the skate guard has a first contact for engaging the blade and a second contact spaced from the blade.

Preferably the first contact and the second contact are connected to a port on the skate guard for connection to a separate charger.

According to a third aspect of the invention there is provided a combination of an ice skate and a charger therefor comprising:

an ice skate comprising:

a boot arranged to receive a person's foot;

a skate blade assembly;

a blade mounting arrangement is arranged to be connected to a sole of the boot and arranged to support a skate blade thereon, and;

a blade heating arrangement having a rechargeable battery power source and a heating element for generating heat from electrical power supplied by the battery power source;

a heat transfer member extending from the heating element to the blade;

an electrical circuit arranged for controlling supply of battery power to the heating element and for controlling charging of the rechargeable battery;

and a charging system comprising;

a skate guard having a support for the blade of the skate;

a first contact for engaging the blade;

and a second contact for engaging the skate at a position thereon spaced from the blade.

Preferably the first contact and the second contact are connected to a port on the skate guard for connection to a separate charger.

BRIEF DESCRIPTION OF THE DRAWINGS

In the accompanying drawings, which illustrate an exemplary embodiment of the present invention.

DETAILED DESCRIPTION

Figure 1:
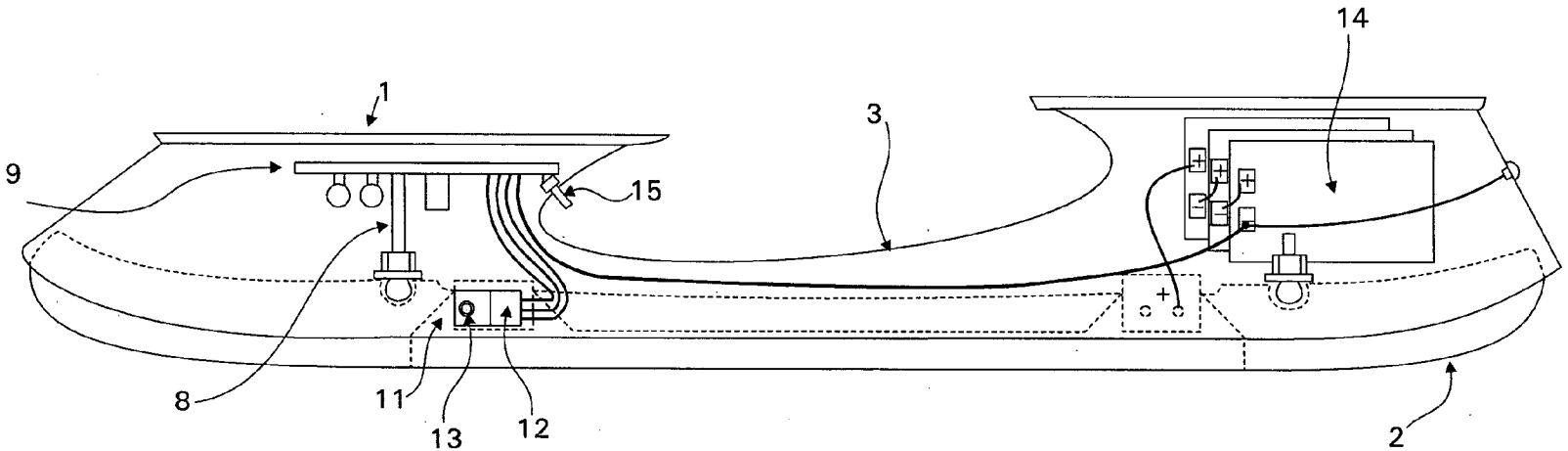
FIG. 1 is a side view of a heated skate according to the present invention showing the blade and mounting for attachment to a skate boot which is omitted for convenience of illustration.
Figure 2:
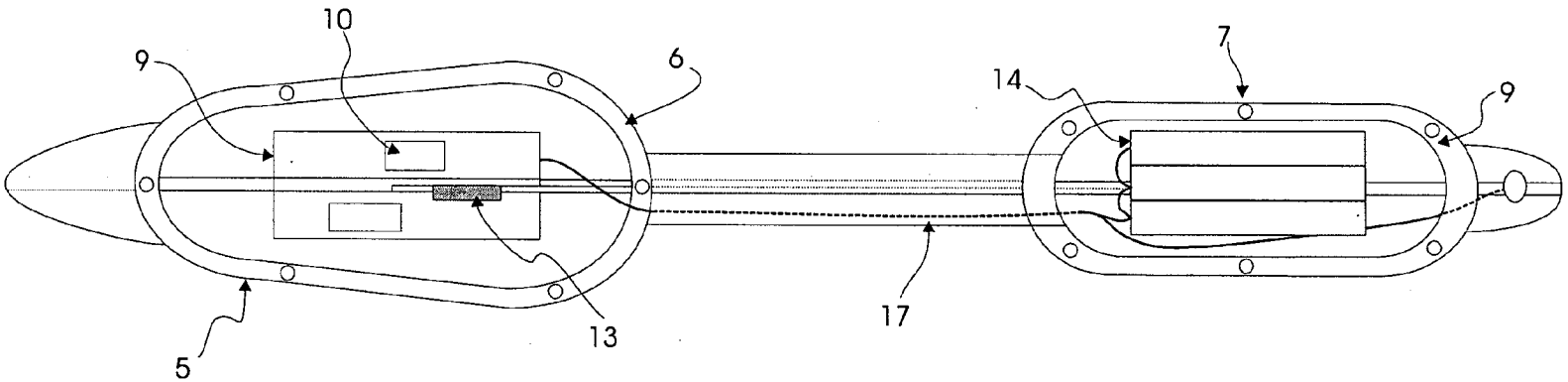
FIG. 2 is a top view of the embodiment of FIG. 1 showing the heating arrangement and power supply.

Referring to the accompanying drawings FIGS. 1 and 2, there is illustrated an ice skate blade assembly 1. The skate blade assembly is of the conventional ice skate type having a blade 2 and a holder 3 to support the blade. The holder has a heel 4, toe 5 and a sole plate flange 6. The sole plate flange has holes 7. The skate blade assembly 1 is generally fastened through the sole plate flange holes 7 through matching holes in the sole of an ice skate boot (not shown) with mechanical fasteners (not shown). The heel 4 and the toe 5 of the skate blade holder 3 generally are hollow.

A heating arrangement 8 is arranged to use an electronic heating circuit to heat the skate blade such that the heat reduces the coefficient of friction of the blade 2 on an ice surface. The heating arrangement 8 has a circuit board 9 mounted in the hollow part of the holder. In an alternative arrangement (not shown) the circuit board can be mounted directly on the blade assembly to itself. The heating arrangement circuit has an electronic controller 10, a thermal conductor 11, a transistor 12 and a temperature sensor 13. The heating arrangement is powered by a battery 14. The battery 14 is connected via an on/off switch 15 to the heating circuit with an insulated wire 17 and by the skate blade 2 utilizing it as an electrical conductor.

The thermal conductor 11 is enclosed within the skate blade 2 and, is arranged to be concealed within the skate blade holder 3 or it may extend below the skate blade holder. A portion of the thermal conductor 11 is arranged to extend up into the blade holder 3 and connect to the transistor 12 which produces the heat.

The skate blades 2 are optionally coated on the side surfaces with a non-stick compound such as Polytetrafluoroethylene (PTFE) to provide an insulating layer between the blade and the air. The non-stick coating also serves to minimise incrustation of ice on the sides of the blade.

Optionally the circuit board 9 has recordable electronic memory for storage of data collected from the electronic devices and or sensors.

Optionally the electronic controller 10 has an internal clock. The clock is used by the electronic controller to execute instructions or functions or collect data on a time counted basis.

Optionally the circuit board 9 has an integral motion sensor 18 used detect the presence or the lack of motion and or to detect the magnitude and frequency of motion. The motion sensor may signal an instruction in the electronic controller and or may store motion data in the electronic memory. The motion detector may signal the electronic controller to turn off the heating if the skate remains motionless for a long period of time Optionally the skate blade assembly 1 has in integrated heart rate sensor used to sense the heart rate of the skater. The heart rate sensor is connected to the electronic controller and may store heart rate data in the electronic memory.

Optionally the circuit board 9 has a radio frequency (RF) transmitter capable of wirelessly transmitting or receiving electronic digital or analog data intermittently or continuously collected from the skate electronics or sensors.

Optionally a visible light emitting diodes (LED) are incorporated to indicate electronic status or functions of the heating system.

Figure 3:
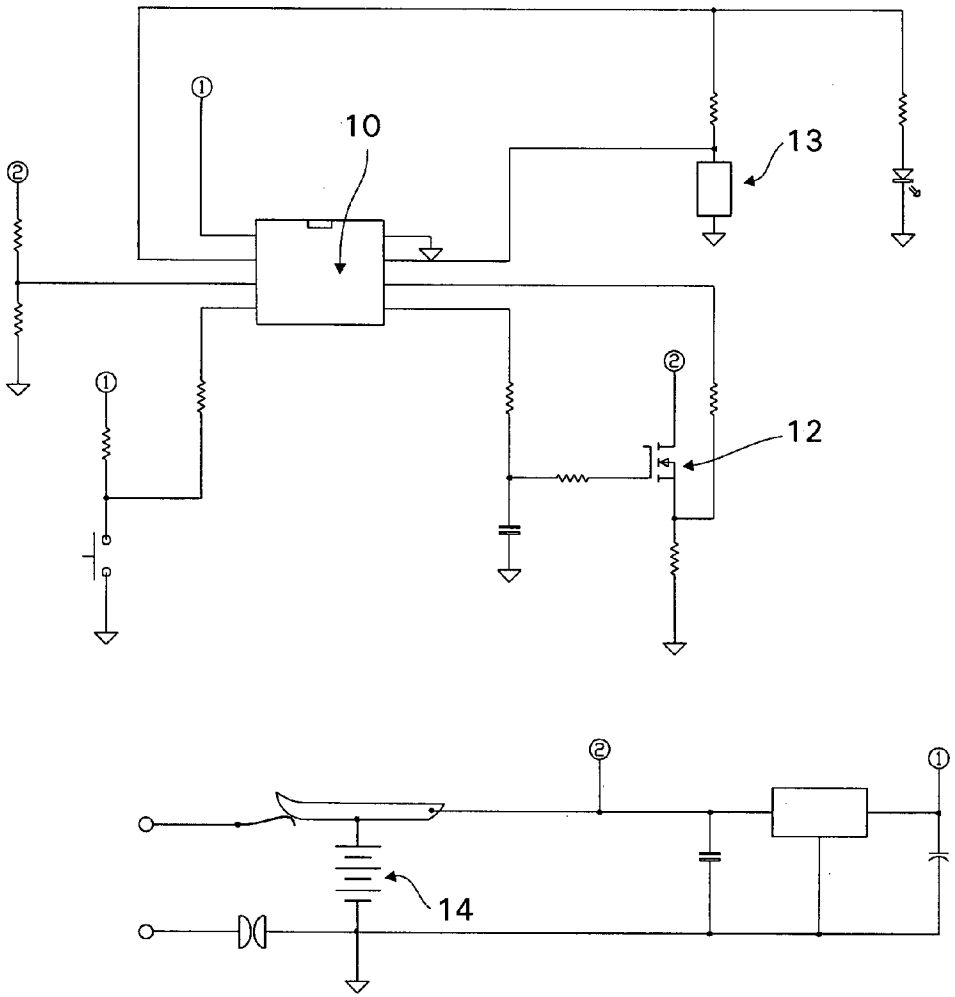
FIG. 3 is a schematic illustration of the heating circuit of the embodiment of FIG. 1.

The circuit, as illustrated in FIG. 3, has an electronic controller 10 which controls the temperature of the blade. The electronic controller 10 is connected to a temperature sensor 13 which senses when the heat to the blade should be turned on or off. During heating, there are two distinct states, heating on and heating off. The thermal conductor is fastened to the skate blade through which the electronic heating arrangement sends the thermal energy to heat the skate blade.

By taking a transistor 12 into the non-linear region of operation, a high efficiency heat source that operates with minimal radio frequency leakage is produced. As the self-destruct region of the power device is easily reached in the configuration, an electronic controller 10 is used to generate a continuously adapting drive waveform. Additionally, the electronic controller also manages the heating on-off, the average current flow, blade temperature and low battery shutdown.

The use of a blade as part of the tuned load as well as the heat sink permits dynamic tuning as a function of the target's current thermal/electrical resistance.

The power source is a rechargeable battery 14 and is regulated for circuit operation and used to supply the transistor 12, preferably a field effect transistor (FET) or a power MOS-FET. This FET or power MOS-FET is supplied power by the electronic controller. The resultant bias is used to operate a tuned snubbing network.

The electronic controller is configured to deliver a buffered and shaped waveform to the transistor 12. This waveform drives the FET 12. The battery 14 is regulated for circuit operation and used to supply the field effect transistor 12.

A temperature sensor 13 is used to monitor blade temperature. The temperature set point is adjustable.

Figure 4:
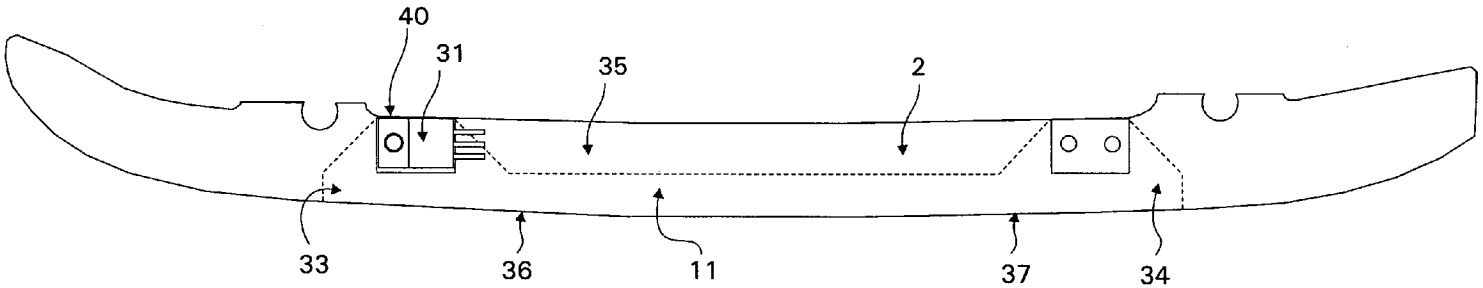
FIG. 4 is a side elevation view of a modified skate blade arrangement for use in the construction of FIG. 1 including a two part blade material.
Figure 5A:
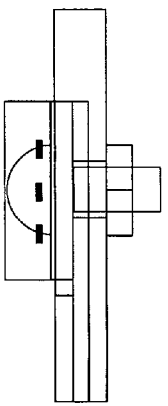
FIG. 5A is a cross section view the blade of FIG. 4.
Figure 5B:
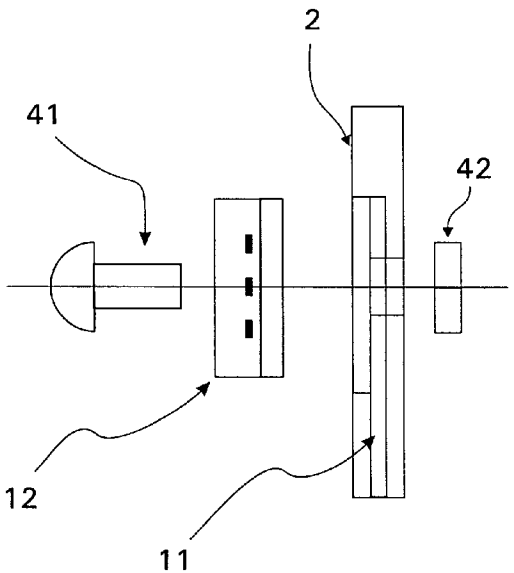
FIG. 5B is an exploded view of FIG. 5A.

FIGS. 4, 5A and 5B are shown a skate blade which is modified relative to the skate blade of the embodiment described above. In this arrangement the skate blade and the heat transfer thermal conductor 11 are formed as a common component providing a blade 2 and an insert portion 31. The insert portion 31 defines a strip 11 having a first end 33 and a second end 34 which is embedded within the steel blade 35. The insert portion can be formed in a manner which extends from the bottom surface of the blade and then is machined in the conventional blade sharpening and forming process so that the bottom edge of the insert portion is machined down with the bottom surface of the blade to form a common sharpened blade edge.

The insert portion 31 extends from the forward edge 33 which is spaced rearward of the front end of the blade and is located adjacent the front mounting of the blade. The rear end 34 extends toward the rear mounting of the blade but is spaced forwardly therefrom. At the forward end, the insert portion tapers upwardly to a narrower upstanding portion 40 which extends to the top of the blade into the mounting to attach to the heating element as a heat sink therefore. The insertion portion is formed from a suitable material having a higher thermal conductivity than steel such as copper thus rapidly transferring the heat from the thermal conductor away from the heating element through the upstanding portion 40, into the tapered portion which communicates the heat to the horizontal bottom elongate portion of the insert portion which is at the bottom edge of the blade so that the majority of the heat is transferred to the bottom edge of the blade rather than to other parts of the blade. Thus the insert portion along its main length has a relatively low height, less than 50% of the height of the blade itself thus carrying the heat primarily to this area. Conveniently the transistor 12 is fastened to the upper portion 40 of the thermal conductor insert 11 with a machine screw 41 and a nut 42. As shown in FIG. 5, the insert portion is sandwiched between two sides of the steel forming the blade so that the heat is transferred through the center of the blade to the required part of the steel adjacent the bottom edge of the blade.

Figures 6A, 6B:
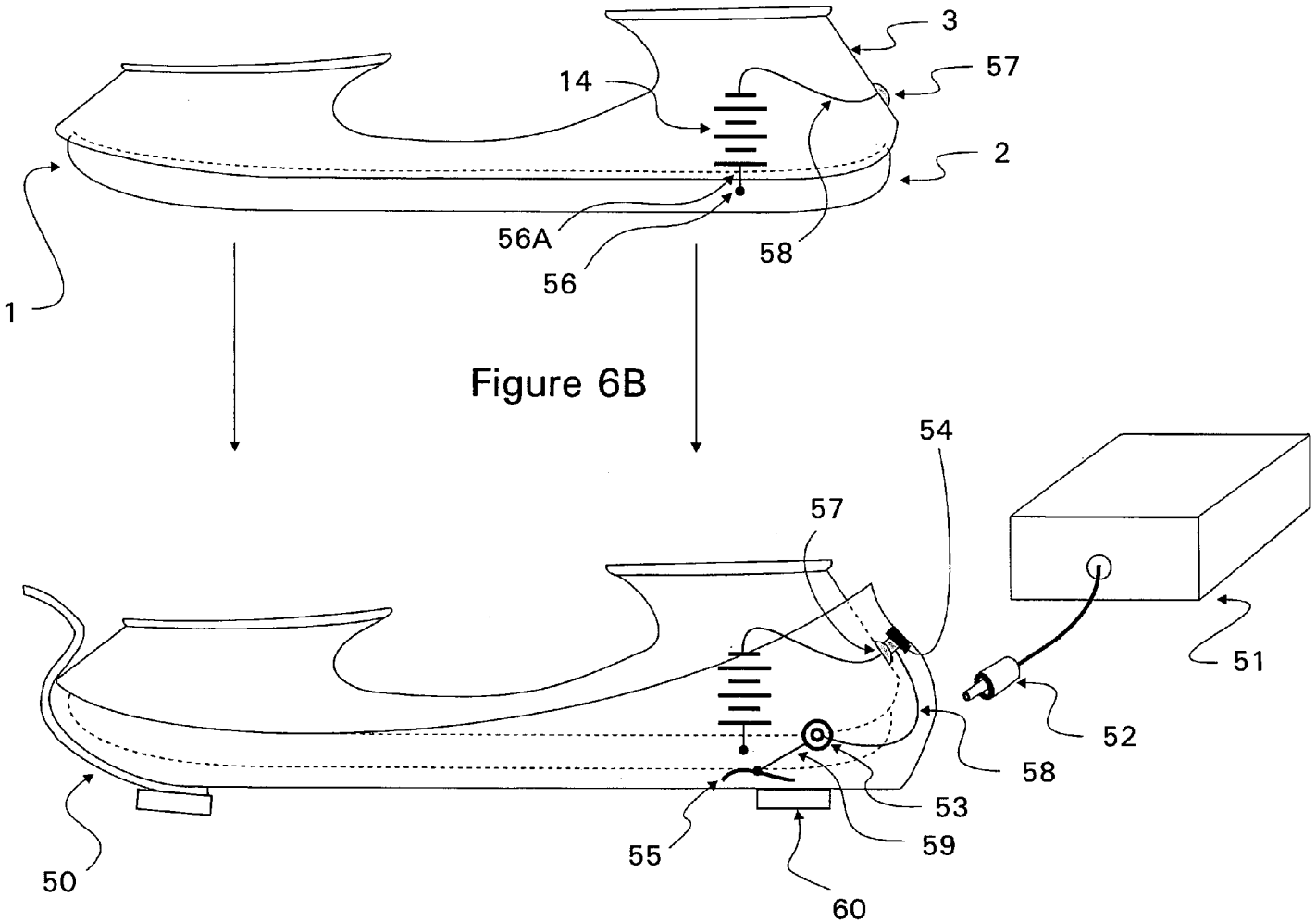
FIG. 6A shows a schematic illustration similar to that of FIG. 1 of a modified embodiment in which the charging of the battery is effected through contact with the blade.
FIG. 6B shows the skate alone of the arrangement of FIG. 6A.

Referring to FIGS. 6A and 6B, there is shown a skate guard and charging stand which is the with a modified circuit arrangement in which the blade itself is used as a contact through which current is supplied for recharging the battery. Thus the blade can be inserted into a skate guard which includes a contact for engaging the blade and a second contact for engaging a suitable ground contact on the skate at the mounting. Thus recharging the battery can be effected simply and quickly by mounting the skate in a suitable guard which provides the voltage at the required level to recharge the battery. Suitable circuit protection elements in the form of a diode are provided to prevent the battery from discharging through the blade during normal use.

The skate batteries charging system embodies a skate guard 50 which is supplied power from a transformer and electronics panel 51. A connector 52 from the charger electronics panel connects to a mating charging port 53 on the skate guard. Wires 58 and 59 connect the charging port with, respectively, a contact 54 on the heel of the skate guard and a spring contact 55 in the bottom slot of the skate guard.

Within the skate blade holder of the skate, one terminal of the battery 14 is connected through a wire 56A to a contact point 56 on the skate blade. The second battery terminal is connected through a wire 58 to a contact 57 on the heel of the skate blade holder.

When the skate 1 is positioned within the skate guard and charging stand 50 electrical contacts 54 and 57 connect and electrical contacts 55 and 56 connect completing the two wire charging circuit. The skate is held properly supported in the guard by stands 60 on the bottom of the guard.

Figure 7A:
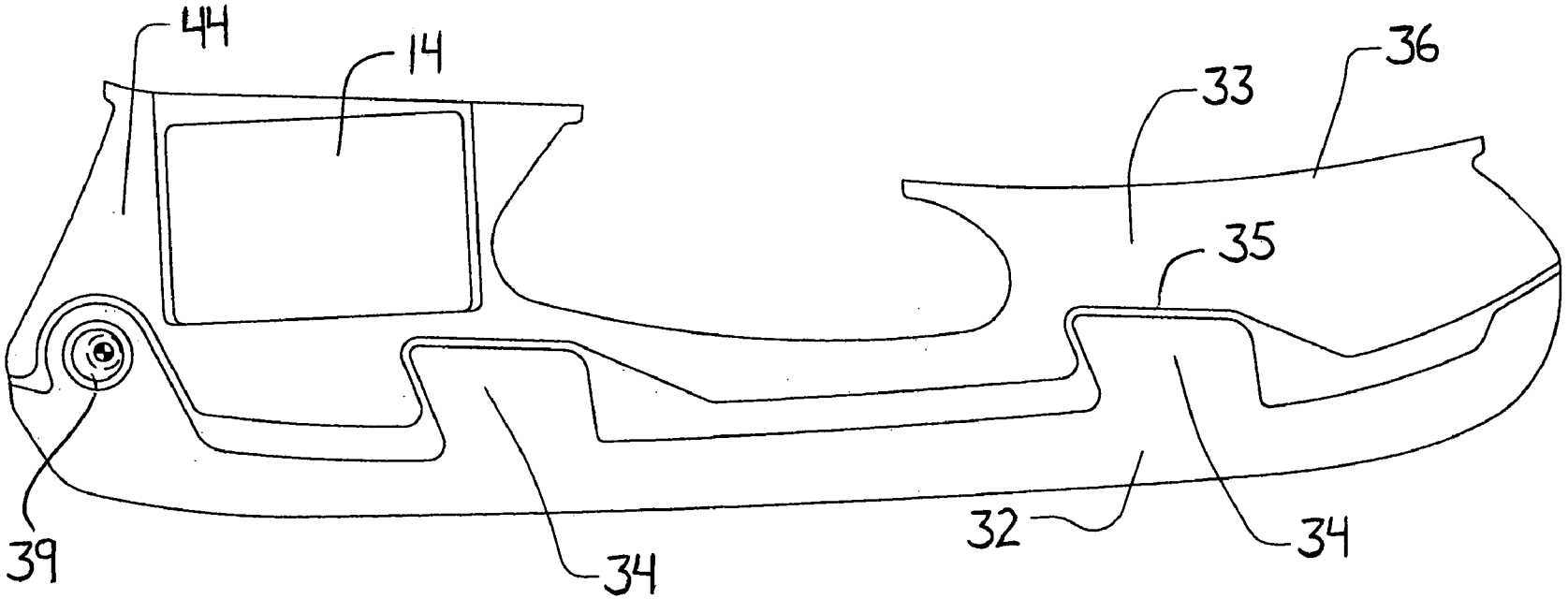
FIG. 7A is a side view similar to that of FIG. 1 of a heated skate blade showing a quick change blade in place attached to a blade holder for mounting on a skate boot which is omitted for convenience of illustration.
Figure 7B:
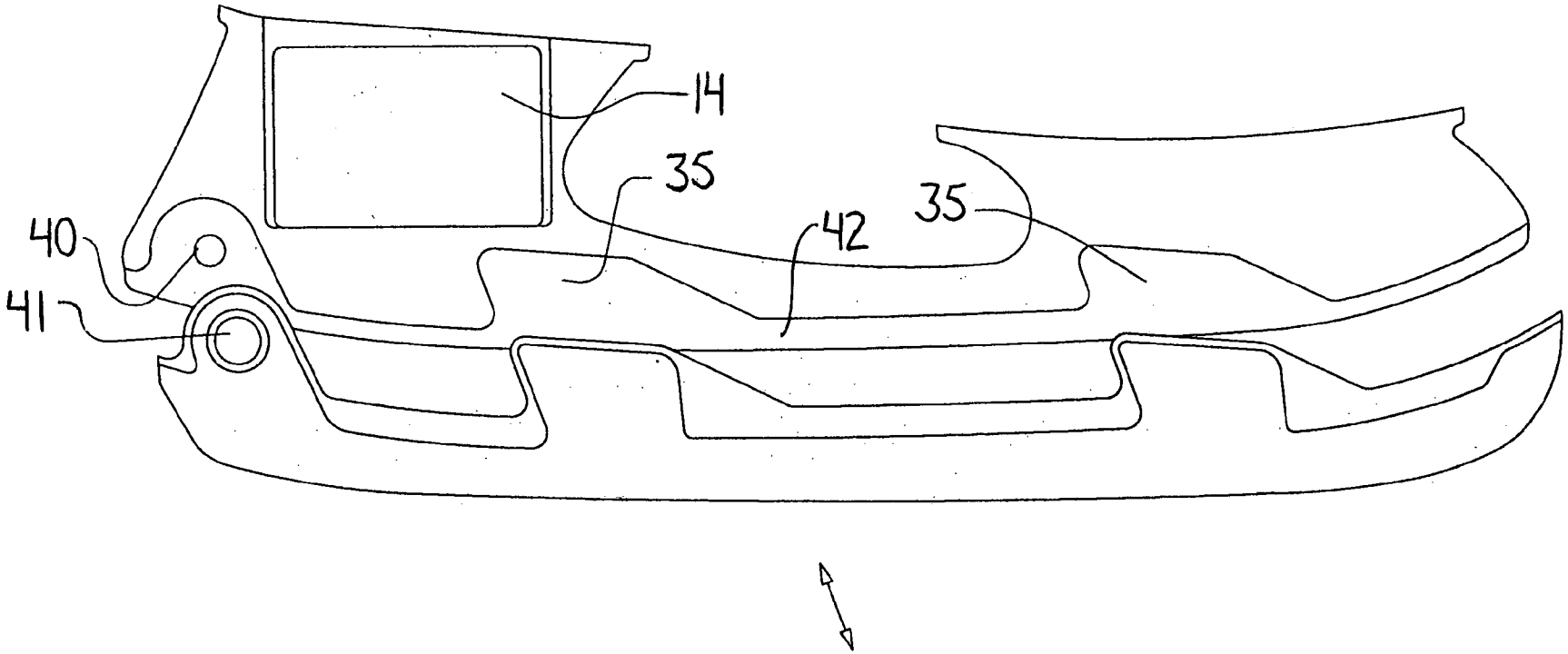
FIG. 7B is a side view of the embodiment of FIG. 7A showing the quick change blade detached.

Referring to FIGS. 7A and 7B there is shown a modified holder 33 and modified skate blade 32. This arrangement permits the quick removal of the skate blade without removing a top plate 36 of the skate holder from the skate boot (not shown) as you would with a conventional skate holder and blade. The blade is held in place with rear angled wedge members 34 on the top of the skate blade 32 which align with matching sockets 35 in the holder. The skate blade is locked into the skating position in the holder by inserting a cam lock mechanical fastener 39 into through aligned holes 40 and 41 and then turned to tightened.

To permit quick changing of the blade 32 without removing the holder 33 from the ice skate boot, the holder or mounting assembly 33 has a longitudinal groove 42 on the bottom of the holder. The longitudinal groove has the front and rear sockets 35 formed therein. The blade 32 is equipped with the matching front and rear wedge members 34 so that when the thin blade body engages into the slot 42 the wedge members 34 engage into that part of the slot which forms the corresponding shaped sockets or receptacles 35. The blade is inserted into the holder positioned near its final mounting position and then pushed in diagonally towards the rear end of the holder. The blade is fastened by inserting the partial turn cam lock 39 into the machined hole 40 in the rear of the holder and matching hole 41 in the blade. After inserting the cam lock 39, it is turned, pulling the blade towards the rear thus tightening the blade in the holder. The blade is removed by reversing the operations.

This arrangement is particularly effective where the circuit board and the heating transistors carried thereon are mounted directly on the blade rather than on the holder. Thus the blade and its heating components with the exception of the battery 14 which remains in its location described in respect of FIG. 1 which is at the rear 44 of the holder 33. Thus the blade is mounted on its mounting arrangement by a manually releasable mechanical coupling for readily removing the blade and the heating element from its mounting. Particularly the manually releasable coupling includes at least one inclined wedge member for cooperating with a corresponding shaped receptacle on the mounting arrangement and a cam lock for pulling the blade along the mounting member longitudinally of the blade and to draw the inclined wedge member into its receptacle.

While one embodiment of the present invention has been described in the foregoing, it is to be understood that other embodiments are possible within the scope of the invention. The invention is to be considered limited solely by the scope of the appended claims.

What is claimed is:

1. An ice skate comprising:

a boot arranged to receive a person's foot;

a skate blade assembly;

a blade mounting arrangement arranged to be connected to a sole of the boot and arranged to support a skate blade thereon, and;

a blade heating arrangement having a rechargeable battery power source and a heating element for generating heat from electrical power supplied by the battery power source;

a heat transfer member extending from the heating element to the blade;

an electrical circuit arranged for controlling supply of battery power to the heating element;

wherein a contact for connection to a charging system for charging the battery power source is defined by the blade.

2. The skate according to claim 1 wherein the blade heating arrangement uses a field-effect transistor controlled by a microprocessor to operate in the non-linear range to heat the skate blade.

3. The skate according to claim 1 wherein at least part of the heating arrangement including the battery power source is mounted within the mounting arrangement and the heat transfer member extends from the blade to the mounting arrangement.

4. The skate according to claim 1 wherein the blade heating arrangement has a motion sensor arranged to control the heating of the blade such that when the skate is in use the blade is heated, when the skate is not in use the heat is off.

5. The skate according to claim 1 wherein the blade has sides which are insulated by a plastic material to provide an insulating layer between the blade and the air.

6. A combination comprising a skate according to claim 1 and a charging system wherein the charging system includes a first contact for engaging the blade and a second contact for engaging the skate at a position thereon spaced from the blade.

7. The combination according to claim 6 wherein the charging system comprises a skate guard for receiving and holding the blade of the skate.

8. The combination according to claim 7 wherein the skate guard has a first contact for engaging the blade and a second contact spaced from the blade.

9. The combination according to claim 8 wherein the first contact and the second contact are connected to a port on the skate guard for connection to a separate charger.

10. A combination of an ice skate and a charger therefor comprising:

an ice skate comprising:

a boot arranged to receive a person's foot;

a skate blade assembly;

a blade mounting arrangement is arranged to be connected to a sole of the boot and arranged to support a skate blade thereon, and;

a blade heating arrangement having a rechargeable battery power source and a heating element for generating heat from electrical power supplied by the battery power source;

a heat transfer member extending from the heating element to the blade;

an electrical circuit arranged for controlling supply of battery power to the heating element and for controlling charging of the rechargeable battery;

and a charging system comprising:

a skate guard having a support for the blade of the skate;

a first contact for engaging the blade;

and a second contact for engaging the skate at a position thereon spaced from the blade.

11. The combination according to claim 10 wherein the first contact and the second contact are connected to a port on the skate guard for connection to a separate charger.

* * * * *